United States Patent [19]

Nuredin

[11] Patent Number: 4,826,151

[45] Date of Patent: May 2, 1989

[54] PUSH-UP AND HAND WALKING EXERCISER

[76] Inventor: Yusuf Nuredin, 2256 W. Berteau, Chicago, Ill. 60610

[21] Appl. No.: 128,048

[22] Filed: Dec. 3, 1987

[51] Int. Cl.[4] ..... A63B 1/00; A47C 7/50

[52] U.S. Cl. ..... 272/93; 272/70; 297/423; 297/439

[58] Field of Search ..... 272/70.3, 93, 64, 146, 272/96, 127, 70; 128/25 B; 297/423, 438, 439; 280/87.02 R, 87.03 R, 87.04 R

[56] References Cited

U.S. PATENT DOCUMENTS

| | | | |
|---|---|---|---|
| 621,098 | 3/1899 | Kelly | 297/439 |
| 2,375,225 | 5/1945 | Herbert | 297/438 |
| 2,850,342 | 9/1958 | Robinson | 297/439 |
| 3,532,356 | 6/1968 | Lillibridge | 280/87.02 |
| 3,767,191 | 10/1973 | Riley | 272/64 |
| 3,784,192 | 1/1974 | Nutter | 272/127 |
| 3,895,795 | 7/1975 | Merz | 272/57 J |
| 4,126,308 | 11/1978 | Crumley | 272/64 |
| 4,232,863 | 11/1980 | Roach | 272/111 |
| 4,621,804 | 11/1986 | Mueller | 272/70.3 |
| 4,621,806 | 11/1986 | Wheeler | 272/93 |

*Primary Examiner*—Richard J. Apley
*Assistant Examiner*—S. R. Crow
*Attorney, Agent, or Firm*—Willian Brinks Olds Hofer Gilson & Lione Ltd.

[57] ABSTRACT

There is disclosed an exercise device that aids in the performance of push-ups and hand walking exercises by elevating the feet about the hands while these exercises are being performed. This device has a rigid ankle support yoke that has two curved portions forming contoured depressions for holding the ankles. The rigid ankle support yoke is supported above the ground by means of a freestanding base, which may have wheels on the bottom.

4 Claims, 1 Drawing Sheet

FIG. 1
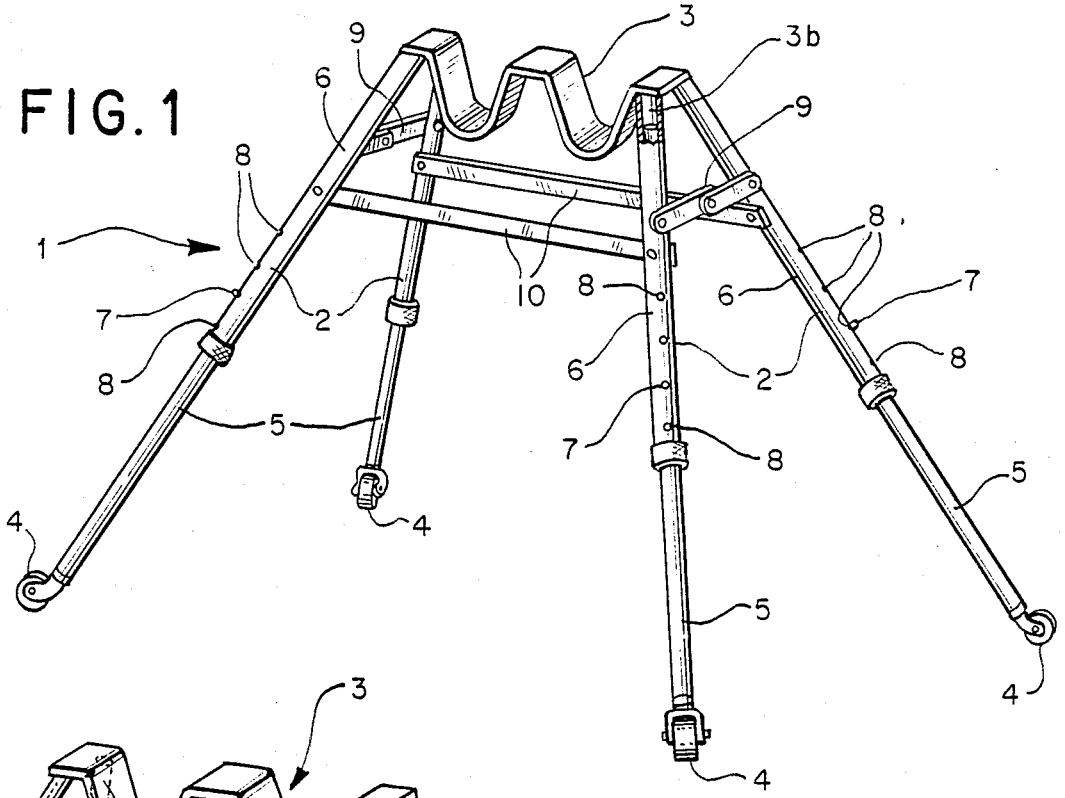
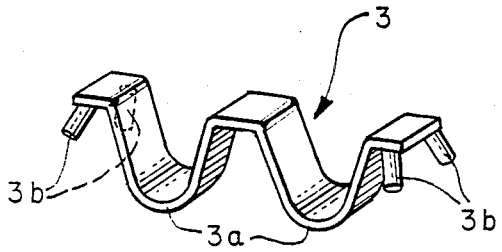
FIG. 2
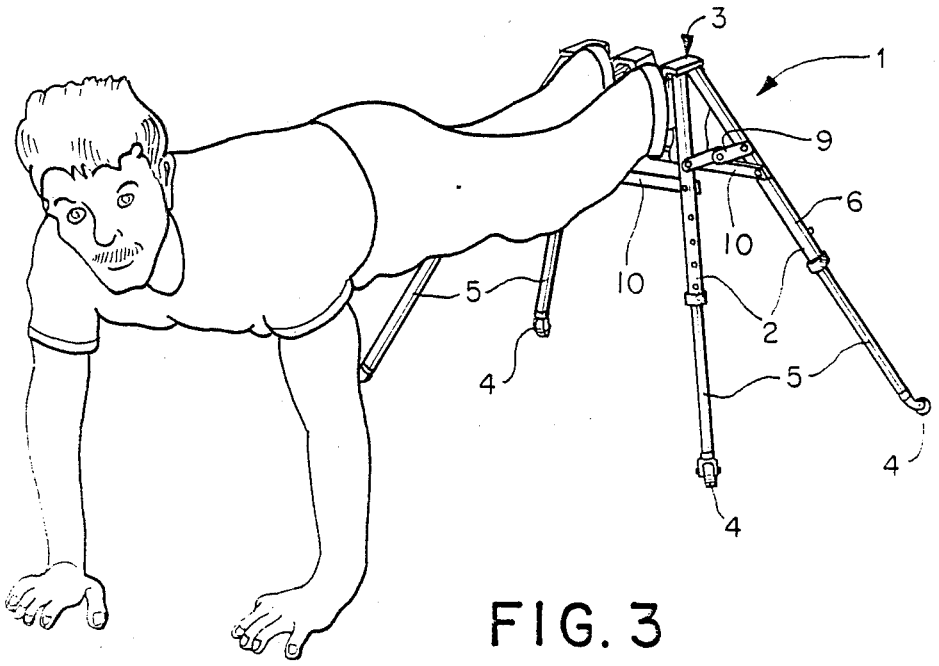
FIG. 3

PUSH-UP AND HAND WALKING EXERCISER

FIELD OF THE INVENTION

This invention is related to exercise devices and is particularly directed to a device that aids in the performance of push-ups and hand walking exercises.

BACKGROUND OF THE INVENTION

The present invention is an advance in the art of exercise devices. The present invention allows an individual to perform push-ups with the feet elevated above the hands and to walk on the hands about a room, gym or the out of doors while having the feet so elevated.

Performing declined push-ups, that is push-ups with the hands being lower than the feet, is a desirable exercise that provides benefits different from performing push-ups in the standard manner, with one's feet on the floor or at the same level as one's hands. Performing declined push-ups can be especially beneficial and useful to boxers and those involved in karate who wish to develop specific portions of their upper body muscles.

Prior to the present invention, to perform declined push-ups, one could use a chair, table, weight lifting bench or similar object to elevate the feet. The use of these objects presents several problems. Their height is generally fixed and thus could not be adjusted to the length of the individual's arms and could not be changed to vary the angle of the individual's body while performing declined push-ups. Such objects are also typically bulky and not easily portable. Moreover, they may require that the feet, and in particular the toes, press against the top of the object in order to elevate the feet. This could cause stress on the toes and feet, and is an uncomfortable position. Also, such objects have no stirrups or braces or other restraints for one's legs and thus one's legs could move about undesirably during the exercise.

As with declined push-ups, walking about on one's hands with the feet elevated is also a beneficial exercise that provides different benefits than doing standard push-ups. This exercise is also fun and has been used as a party and picnic game commonly called wheel barrow races. Prior to the present invention, to perform this hand walking exercise the assistance of another would be needed to hold the individual's feet up and walk with the individual doing the exercise. Additionally, the objects commonly used to elevate the feet for declined push-ups, which are discussed above, can not be used for this hand walk exercise because they are stationary.

SUMMARY OF INVENTION

It is the principal object of this invention to provide a portable freestanding light weight exercise device that elevates the feet above the hands so that push-ups can be performed in this position, and that also allows an individual to walk about on the hands with the feet so elevated.

To this end the present invention comprises an exercise device having a freestanding base, which can consist of support legs. The base has a bottom and a top to which a rigid ankle support yoke is attached. The rigid ankle support yoke being made from metal or other similarly rigid material, has two curved portions which form contoured depressions in which ones ankles are placed. When the bottom of the base is placed on a surface, such as the floor of a room, the ankles can be placed in the contoured depressions of the rigid ankle support yoke, thus elevating the feet above the hands, which are placed on the floor, so that push-ups can be performed in this position. Additionally, wheels can be added to the bottom of the base to enable one to walk around on the hands with the feet so elevated.

BRIEF DESCRIPTION OF THE DRAWINGS

FIG. 1 is a perspective view of an embodiment of an exercise device made in accordance with the present invention.

FIG. 2 is a perspective view of an embodiment of the rigid ankle support yoke that forms part of the present invention.

FIG. 3 is a perspective view of an embodiment of the present invention that shows the present invention being used for one of its intended purposes, such as declined push-ups or hand-walking.

DETAILED DESCRIPTION OF EMBODIMENTS OF THE INVENTION

An embodiment of an exercise device made in accordance with the present invention is illustrated in FIG. 1. This exercise device has a portable freestanding base 1 that consists of support legs 2. The support legs can be constructed from hollow metal tubing but other similar materials known to the art may used. The support legs have top ends to which a rigid ankle support yoke 3 is attached. The support legs have bottom ends to which wheels 4 are attached. The wheels may be removable or permanently attached. The support legs are preferably constructed of two telescoping tubes, an inner tube 5 and an outer tube 6. The inner tube 5 has a spring loaded pin 7 which extends through holes 8 in the outer tube 6. Thus, the degree of extension of the inner tube 5, and consequently the length of the support leg 2, is adjusted by varying the hole 8 through which the spring loaded pin 7 extends. Other means for adjustment may also be employed.

The support legs are joined by a collapsible linking means such as a connecting hinge 9 including flat metal plates or levers with a pop rivet or a bolt forming a pivot point. Other connecting means such as a chain or rope may also be employed. The support legs are also joined by rigid cross braces 10.

The rigid ankle support yoke 3, as shown in the embodiment illustrated in FIG. 2, has curved portions **3*a* forming contoured depressions. These curved portions 3*a* are shaped to receive and support the ankles of the person using the present invention. The rigid ankle support yoke can be made from metal or other material of similar strength and rigidity. The rigid ankle support yoke may also be covered with padding (not shown). Pins 3*b* are attached to the outer ends of the rigid ankle support yoke. These pins 3*b* connect the rigid ankle support yoke 3 to the legs 2 by insertion of the pins 3*b* into the hollow portion of the tops of the legs 2**.

The use of a device embodying the present invention can be seen in FIG. 3. It should be noted that the ankles are received by the contoured depressions formed by the curved portions of the rigid ankle support yoke and support the ankles, keeping the feet well above the the hands.

While the invention has been described in connection with a certain presently preferred embodiment, those skilled in the art will recognize modifications to structure, arrangement, portions, elements, material, and components which can be used in the practice of the invention without departing from the principles of this invention. I intend that the following claims cover all such modifications.

What is claimed is:

1. A portable exercise device for aiding in the performance of push-ups with the feet elevated above the hands comprising:

a rigid ankle support yoke having a first end and a second end, the first end having a first set of connecting pins attached thereto, the second end having a second set of connecting pins attached thereto, and the rigid ankle support yoke having two curved portions between the first and the second end; and a first set and a second set of support legs, each support leg having a bottom end and a top end, the first set of connecting pins connected to the top ends of the first set of support legs, and the second set of connecting pins connected to the top ends of the second set of support legs, such that the rigid ankle support yoke is supported above a surface when the bottom ends of the support legs are positioned on top of the surface.

2. The portable exercise device of claim 1 wherein the first set of support legs is connected by a first collapsible linking means and the second set of support legs is connected by a second collapsible linking means.

3. The portable exercise device of claim 1 wherein wheels are attached to the bottom ends of the support legs such that the device can aid in the performance of hand-walking exercises.

4. The portable exercise device of claim 1 wherein the support legs are adjustable so that the distance between the top end and the bottom end can be changed.

* * * * *